US011746573B2

(12) United States Patent
Lim et al.

(10) Patent No.: US 11,746,573 B2
(45) Date of Patent: Sep. 5, 2023

(54) EMERGENCY OPENING STRUCTURE FOR FRUNK LATCH

(71) Applicants: Hyundai Motor Company, Seoul (KR); Kia Motors Corporation, Seoul (KR); PYEONG HWA AUTOMOTIVE CO., LTD., Daegu (KR)

(72) Inventors: Sang Kyoon Lim, Bucheon-si (KR); Ki Ryun Ahn, Daegu (KR); Hyeon Tae Park, Daegu (KR)

(73) Assignees: Hyundai Motor Company, Seoul (KR); Kia Motors Corporation, Seoul (KR); Pyeong Hwa Automotive Co., Ltd., Daegu (KR)

( * ) Notice: Subject to any disclaimer, the term of this patent is extended or adjusted under 35 U.S.C. 154(b) by 265 days.

(21) Appl. No.: 16/899,471

(22) Filed: Jun. 11, 2020

(65) Prior Publication Data

US 2021/0189777 A1 Jun. 24, 2021

(30) Foreign Application Priority Data

Dec. 18, 2019 (KR) ..... 10-2019-0169418

(51) Int. Cl.
*E05B 79/20* (2014.01)
*E05B 83/24* (2014.01)
*E05B 83/26* (2014.01)

(52) U.S. Cl.
CPC ..... *E05B 83/26* (2013.01); *E05B 79/20* (2013.01); *E05B 83/24* (2013.01); *E05Y 2900/536* (2013.01)

(58) Field of Classification Search
CPC ..... E05B 83/26; E05B 79/20; E05B 83/24; E05B 79/22; E05B 83/18; E05B 85/243; E05Y 2900/536
See application file for complete search history.

(56) References Cited

U.S. PATENT DOCUMENTS 5,131,288 A * 7/1992 Barias ..... B60T 7/045 74/501.5 R
5,662,369 A * 9/1997 Tsuge ..... B60N 2/366 292/225

(Continued)

FOREIGN PATENT DOCUMENTS

CN 101657590 A 2/2010
CN 104514449 A 4/2015

(Continued)

*Primary Examiner* — Kristina R Fulton
*Assistant Examiner* — Thomas L Neubauer
(74) *Attorney, Agent, or Firm* — Slater Matsil, LLP

(57) ABSTRACT

An emergency opening structure for a frunk latch includes a base, a pawl disposed on the base, the pawl being configured to be rotatable, a first cable to which tension is applied by operation of an in-vehicle handle, a release lever configured to apply tension of the first cable to the pawl, a blade lever located at the release lever, the blade lever being configured to cause the pawl and the release lever to be operated together when the release lever is rotated by the first cable, a second cable to which tension is applied by operation of an in-frunk handle, an emergency lever having one end connected to the second cable and an opposite end configured to be rotatable and to interlock with the pawl, and a catch configured to be operated together with the pawl to unlock a striker.

20 Claims, 11 Drawing Sheets

(56) References Cited

U.S. PATENT DOCUMENTS

| | | | | |
|---|---|---|---|---|
| 6,135,514 | A * | 10/2000 | Kowalewski | E05B 79/20 292/216 |
| 6,247,732 | B1 * | 6/2001 | Alton | E05B 79/20 292/216 |
| 6,369,395 | B1 * | 4/2002 | Roessler | B60Q 3/30 250/462.1 |
| 6,485,801 | B1 * | 11/2002 | Chen | G09F 19/02 D21/465 |
| 6,519,986 | B2 * | 2/2003 | Wicker | E05B 77/26 292/216 |
| 6,776,554 | B2 * | 8/2004 | Acciacca | E05B 79/20 292/225 |
| 8,608,221 | B1 * | 12/2013 | Krajenke | E05B 83/18 49/386 |
| 2002/0157435 | A1 | 10/2002 | Wicker | |
| 2002/0163207 | A1 * | 11/2002 | Rogers, Jr. | E05B 83/16 292/216 |
| 2003/0164616 | A1 * | 9/2003 | Belmond | E05B 77/30 292/201 |
| 2010/0013246 | A1 | 1/2010 | Tomaszewski et al. | |
| 2013/0104459 | A1 * | 5/2013 | Patel | E05B 85/12 292/201 |
| 2013/0140831 | A1 * | 6/2013 | Kempel | E05B 83/26 292/3 |
| 2015/0097379 | A1 | 4/2015 | Spurr et al. | |
| 2015/0345186 | A1 | 12/2015 | Park | |
| 2016/0362917 | A1 | 12/2016 | Cumbo | |

FOREIGN PATENT DOCUMENTS

| | | | |
|---|---|---|---|
| CN | 204941106 | U | 1/2016 |
| KR | 101560979 | B1 | 10/2015 |

* cited by examiner

EMERGENCY OPENING STRUCTURE FOR FRUNK LATCH

CROSS-REFERENCE TO RELATED APPLICATIONS

This application claims priority to Korean Patent Application No. 10-2019-0169418, filed on Dec. 18, 2019, which application is hereby incorporated herein by reference.

TECHNICAL FIELD

The present disclosure relates to an emergency opening structure for a frunk latch.

BACKGROUND

In general, a vehicle is provided at the front portion thereof with an engine compartment, which is opened and closed by a front hood. The front hood functions not only to open and close the engine compartment but also to shield the engine compartment to block engine noise. The front hood is coupled at left and right sides of the rear end thereof to the upper portion of the engine compartment via hinge assemblies, and opens and closes the engine compartment by rotating about the hinge assemblies.

In recent years, electric vehicles, in which a battery is mounted to the floor of the vehicle body, have been actively developed as a substitute for typical vehicles, in which a powertrain, including an engine and a transmission, is mounted in an engine compartment. In such an electric vehicle, the space present in the front portion of the vehicle body (i.e. the space corresponding to the engine compartment, in which a typical powertrain is mounted) is utilized as a trunk. Since this trunk is provided in the front portion of the vehicle body, it is generally called a front trunk or a frunk.

In general, the hood of a vehicle is structured to be locked in two stages. In order to unlock the hood, a user first operates a release lever in the interior of the vehicle such that the first-stage locked state is released by operation of a cable, and then the user puts his hand into the engine compartment in front of the vehicle to unlatch a safety lever, thereby releasing the second-stage locked state. As such, the hood of a vehicle has a two-stage safety structure.

This is provided to satisfy vehicle safety standard regulations. Accordingly, a firm hood latch device needs to be installed at the hood of a vehicle. A vehicle having a hood structure in which the hood is opened and closed at the front portion of the vehicle is regulated so as to have a two-stage locking structure or a two-point locking structure for the hood in order to prevent the hood from opening and obstructing a driver's field of vision while driving.

In general, the operation of opening the hood includes a first-stage opening operation for unlocking a hood latch and a second-stage opening operation in which the user flips a safety lever in an opening direction.

In this case, the safety lever functions to prevent the hood from popping up instantaneously upon the first-stage opening operation. After performing the second-stage opening operation, i.e. flipping the safety lever in the opening direction, the user is capable of lifting up the hood.

However, in the case in which the hood is equipped with latch structures used respectively for the first-stage opening operation and the second-stage opening operation, the weight and installation cost of the hood increases, and a large installation space is required. Further, in the case of installing a separate electric latch, installation costs increase, and the probability of failure increases.

The above information disclosed in this Background section is only for enhancement of understanding of the background of the disclosure and therefore it may contain information that does not form the related art that is already known to a person of ordinary skill in the art.

A dual unlocking hood latch system is disclosed in US Pat. Pub. No. 2015/0345186, which claims priority to Korean Patent Registration No. 10-1560979.

SUMMARY

The present disclosure relates to an emergency opening structure for a frunk latch. Particular embodiments relate to an emergency opening structure for a frunk latch, which enables not only a basic opening mode but also an emergency opening mode, in which a person locked in the frunk is capable of opening the frunk, using a single latch structure.

Embodiments of the present disclosure can solve problems associated with the related art, and an embodiment of the present disclosure provides an emergency opening structure for a frunk latch, which enables not only a basic opening mode but also an emergency opening mode, in which a person locked in the frunk is capable of opening the frunk, using a single latch structure.

Another embodiment of the present disclosure provides an emergency opening structure for a frunk latch, which is configured such that a latch is operated in a mechanical manner, rather than in an electrical manner.

Embodiments of the present disclosure are not limited to the above-mentioned embodiments, and other embodiments not mentioned herein will be clearly understood by those skilled in the art from the following description, and will become apparent with reference to the described embodiments of the present disclosure. In addition, the embodiments of the present disclosure can be accomplished by the components described in the appended claims and combinations thereof.

One embodiment of the present disclosure provides an emergency opening structure for a frunk latch, including a base secured to a vehicle body, a pawl disposed on one surface of the base and configured to be rotatable, a first cable to which tension is applied by operation of an in-vehicle handle, a release lever configured to apply tension of the first cable to the pawl, a blade lever located at the release lever and configured to cause the pawl and the release lever to be operated together when the release lever is rotated by the first cable, a second cable to which tension is applied by operation of an in-frunk handle, an emergency lever configured such that the second cable is connected to one end thereof and such that an opposite end thereof is rotatable and is interlocked with the pawl, and a catch configured to be operated together with the pawl to unlock a striker.

In a preferred embodiment, the pawl may be rotated when the blade lever catches on a boss located at one end of the pawl.

In another preferred embodiment, the boss of the pawl may include a first boss located at the pawl to cause the pawl to release first-stage locking when one end of the blade lever catches thereon, and a second boss located at the pawl to cause the pawl to release second-stage locking when additional tension is applied to the first cable and the end of the blade lever catches thereon.

In still another preferred embodiment, the blade lever may be located on one surface of the release lever, and when tension is applied to the release lever from the first cable, the blade lever may catch on the first boss or the second boss and may rotate the pawl.

In yet another preferred embodiment, the emergency opening structure may further include an emergency link located at the opposite end of the emergency lever, and when the emergency lever is rotated by the second cable, the emergency link may rotate one end of the pawl.

In still yet another preferred embodiment, the emergency link may be configured to rotate the pawl.

In a further preferred embodiment, the emergency link may include a guide slot formed therein into which a protruding part of the base is inserted, and the emergency link may move while being guided by the protruding part to rotate the pawl.

In another further preferred embodiment, the catch may include a first latching protrusion and a second latching protrusion, and when the pawl rotates, the first latching protrusion and the second latching protrusion may sequentially catch on the pawl.

In still another further preferred embodiment, the emergency opening structure may further include an elastic member located on the center shaft of the catch to rotate the catch in a direction in which the striker is unlocked.

In yet another further preferred embodiment, when rotational force is applied to the emergency lever, the emergency lever may rotate the pawl such that the first latching protrusion and the second latching protrusion of the catch are released from the pawl.

Other aspects and preferred embodiments of the disclosure are discussed infra.

It is understood that the term "vehicle" or "vehicular" or other similar term as used herein is inclusive of motor vehicles in general such as passenger automobiles including sports utility vehicles (SUVs), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The above and other features of the disclosure are discussed infra.

BRIEF DESCRIPTION OF THE DRAWINGS

The above and other features of the present disclosure will now be described in detail with reference to certain exemplary embodiments thereof illustrated in the accompanying drawings which are given hereinbelow by way of illustration only, and thus are not limitative of the present disclosure, and wherein.

Figure 1:
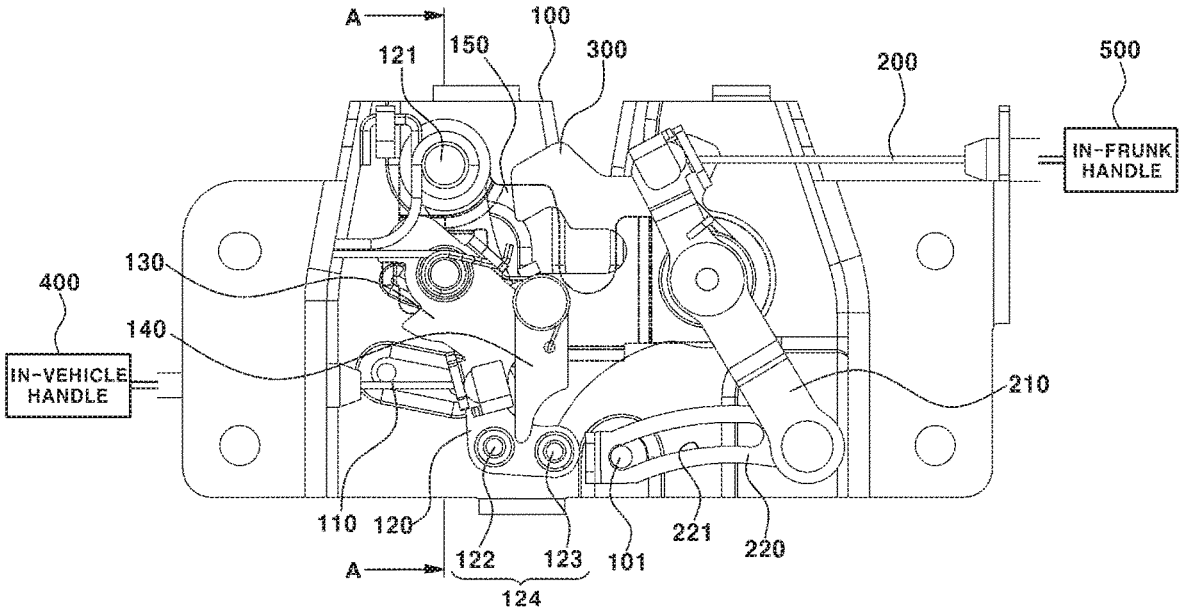
FIG. 1 is a front view of an emergency opening structure for a frunk latch according to an embodiment of the present disclosure.

It should be understood that the appended drawings are not necessarily to scale, presenting a somewhat simplified representation of various preferred features illustrative of the basic principles of the embodiments of the disclosure. The specific design features of the embodiments of the present disclosure as disclosed herein, including, for example, specific dimensions, orientations, locations, and shapes, will be determined in part by the particular intended application and use environment.

In the figures, reference numbers refer to the same or equivalent parts of the present disclosure throughout the several figures of the drawings.

DETAILED DESCRIPTION OF ILLUSTRATIVE EMBODIMENTS

Hereinafter, embodiments of the present disclosure will be described in detail with reference to the accompanying drawings. The present disclosure may, however, be embodied in many different forms, and should not be construed as being limited to the embodiments set forth herein. Rather, these embodiments are provided so that the disclosure will be more thorough and complete, and will more fully convey the scope of the disclosure to those skilled in the art.

The terms "part", "unit", and "member" used in the specification mean units for processing at least one function or operation, and may be implemented using hardware components, software components, or combinations thereof.

Further, the term "frunk" used in the specification includes both a front frunk and a rear trunk, and the following description in the specification will focus on one end of the frunk.

Furthermore, the term "basic mode" used in the specification is a mode in which a frunk is opened in a normal situation, and the term "emergency mode" is a mode in which the frunk is opened by a person locked in the frunk.

Embodiments of the present disclosure relate to a latch structure in which an unlocking operation is realized through two-stage rotation upon manipulating an in-vehicle handle 400 twice in the basic mode. Further, embodiments of the present disclosure provide an emergency opening structure for a frunk latch in which an emergency lever 210, interlocked with a second cable 200, is provided on a base 100 so as to unlock a catch 300 upon manipulating an in-frunk handle 500 once in the emergency mode.

That is, in the basic mode, upon first manipulation of the in-vehicle handle 400, a completely locked state, in which a first latching protrusion 310 of the catch 300 catches on a pawl 120, is changed to a first unlocked state, in which a second latching protrusion 320 of the catch 300 is caught in a recess in the pawl 120, and is subsequently changed to a completely unlocked state, in which the first latching protrusion 310 and the second latching protrusion 320 are completely released from the pawl 120, upon second manipulation of the in-vehicle handle 400. In the emergency mode, upon manipulation of the in-frunk handle 500 once, the pawl 120 and the catch 300 are successively rotated so as to unlock the frunk.

Figure 2:
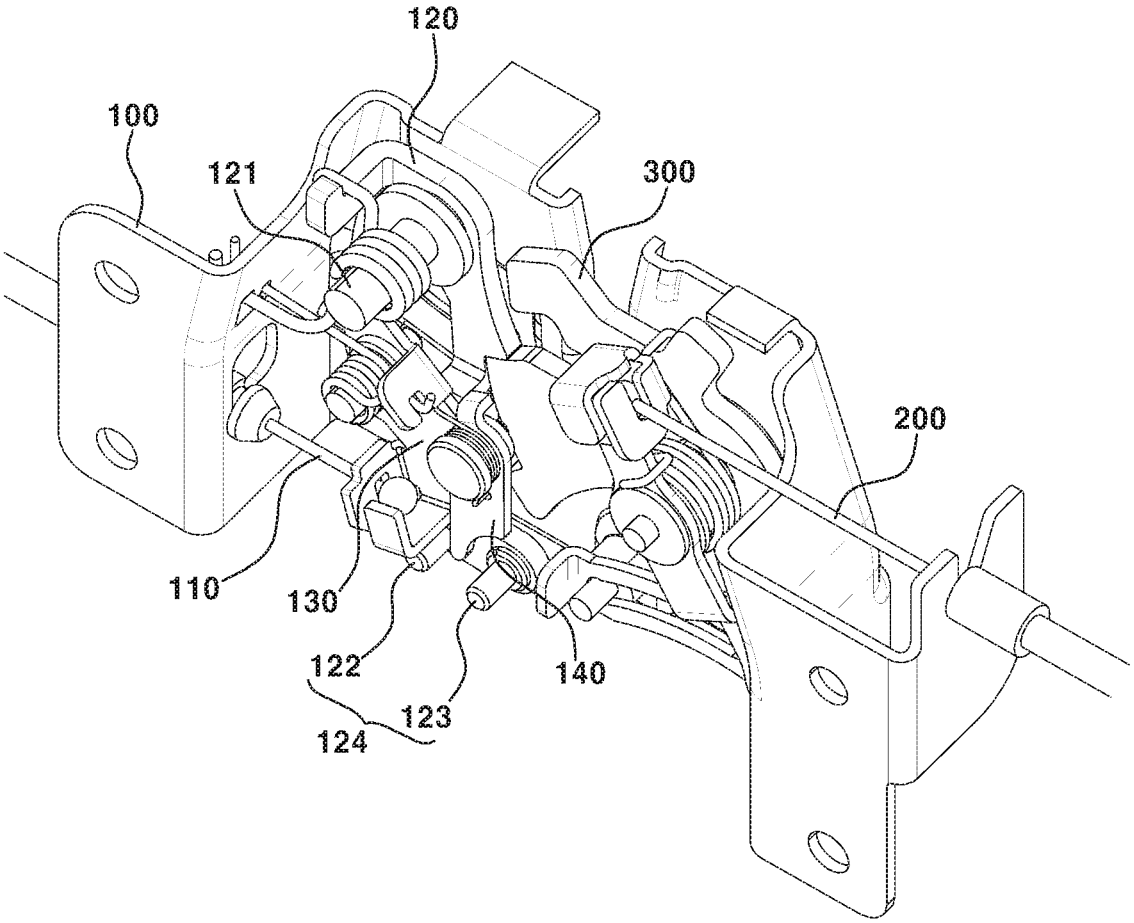
FIG. 2 is a perspective view of an emergency opening structure for a frunk latch according to an embodiment of the present disclosure.
Figure 3:
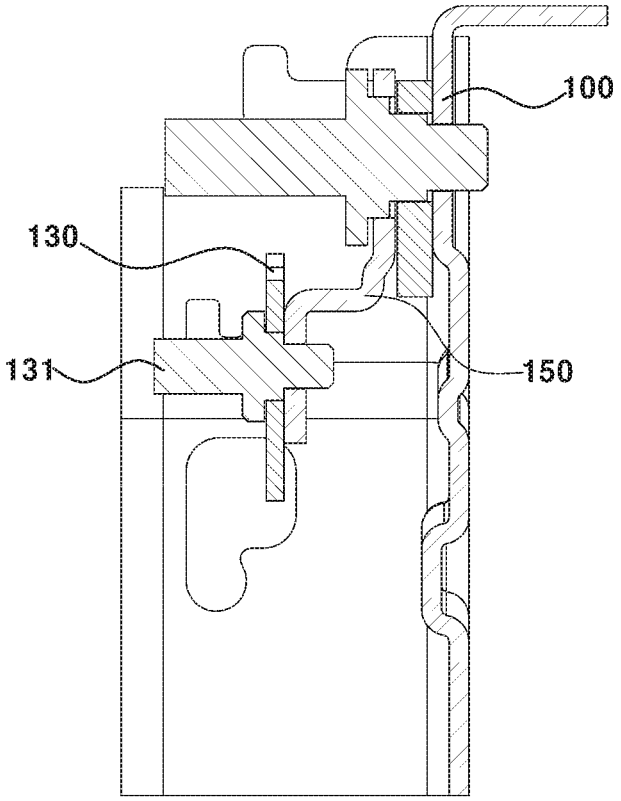
FIG. 3 is a side view of an emergency opening structure for a frunk latch according to an embodiment of the present disclosure.

FIGS. 1 to 3 are views illustrating an emergency opening structure for a frunk latch according to embodiments of the present disclosure.

As shown in the drawings, the emergency opening structure for a frunk latch may include a base 100, which is secured to a vehicle body, and may further include a pawl 120, a release lever 130, and a blade lever 140, which are disposed on one surface of the base 100. A catch 300 is provided so as to be located adjacent to the pawl 120 in the same plane as the pawl 120. The catch 300 includes a first latching protrusion 310 and a second latching protrusion 320, which are formed so as to be caught in a recess formed in one side surface of the pawl 120.

The pawl 120 is configured to rotate about a pawl center shaft 121, which is located on one surface of the upper end portion of the base 100. A release lever 130 is provided so as to be located in front of the pawl 120.

The release lever 130 may be configured to be coupled to a back plate 150, which surrounds the pawl center shaft 121. The back plate 150 may be located such that the pawl 120 and the release lever 130 are spaced apart from each other in the forward-backward direction of the base 100. The release center shaft 131 of the release lever 130 may be located on the back plate 150. A first cable 110, which is connected to an in-vehicle handle 400, is connected to a portion of the release lever 130.

The blade lever 140 is located on one surface of the release lever 130. A blade center shaft 141 is located on the release lever 130. Thus, when the first cable 110 applies tension to the release lever 130, the blade lever 140 pivots on one surface of the release lever 130.

More preferably, when the release lever 130 receives tension from the first cable 110 and thus rotates, the blade lever 140 moves in the downward direction about the blade center shaft 141 located on one surface of the release lever 130.

The other end of the blade lever 140, which is opposite the end of the blade lever 140 at which the blade center shaft 141 is located, selectively catches on bosses 124 of the pawl 120 such that the rotational force applied to the blade lever 140 is transmitted to the pawl 120.

More preferably, in the basic mode, the release lever 130 is rotated by the tension applied to the first cable 110 in response to the operation of manipulating the in-vehicle handle 400 once, and the blade lever 140, which is on one surface of the release lever 130, is introduced into a space between a first boss 122 and a second boss 123. Further, the slanted surface of the blade lever 140 moves downward while contacting one end of the second boss 123, and then catches on the first boss 122. Thereby, the pawl 120 is rotated in the same direction as the blade lever 140.

Further, in response to the operation of manipulating the in-vehicle handle 400 twice, one end of the blade lever 140 catches on the other end of the second boss 123 such that the pawl 120 is further rotated. In the basic mode, in the locked state, in which the first latching protrusion 310 of the catch 300 catches on the pawl 120, when the in-vehicle handle 400 is manipulated once, the release lever 130 is rotated, and the blade lever 140 is introduced into the space between the first boss 122 and the second boss 123 so as to transmit tension applied from the first cable 110. The second latching protrusion 320 of the catch 300 is located so as to correspond to the recess in the pawl 120.

In the state in which the first-stage locking is released in the above manner, when the in-vehicle handle 400 is additionally manipulated, the blade lever 140 catches on the second boss 123 so as to apply tension to the pawl 120, thereby releasing the second-stage locking of the frunk.

Meanwhile, in the emergency mode, tension is applied to a second cable 200, which is located at one end of an emergency lever 210, and an emergency link 220, which is located at the other end of the emergency lever 210, is rotated so as to catch on the pawl 120. Further, the catch 300, which catches on the pawl 120, is successively rotated, thereby unlocking the frunk.

Hereinafter, the operation of releasing the first-stage locking of the frunk by manipulating the in-vehicle handle 400 in the basic mode will be described with reference to FIGS. 4A to 4C.

Figure 4A:
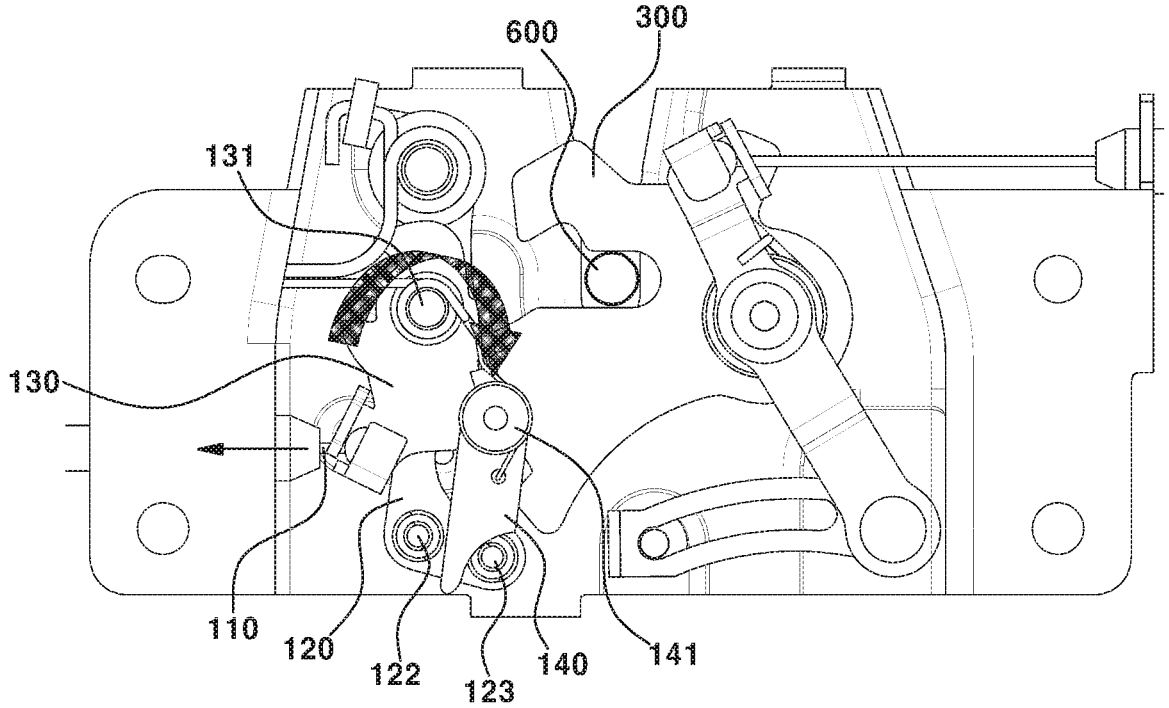
FIG. 4A is a view illustrating the state in which tension is applied to a first cable in an emergency opening structure for a frunk latch according to an embodiment of the present disclosure.
Figure 4B:
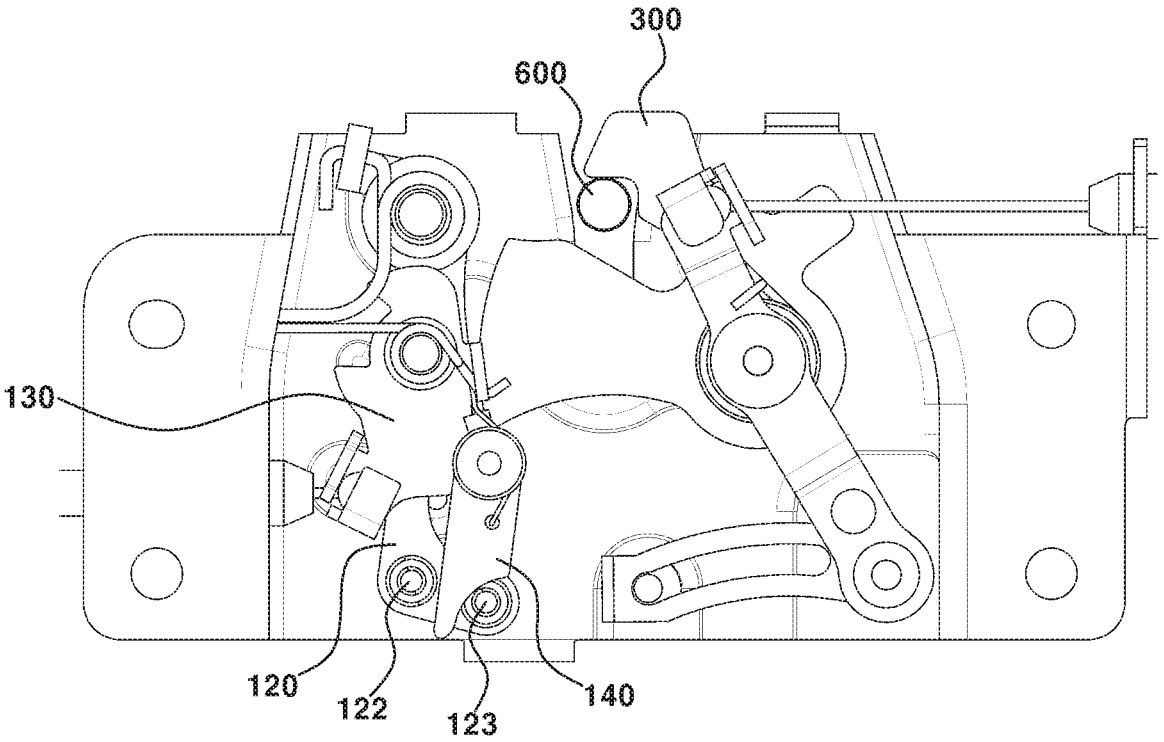
FIG. 4B is a view illustrating the state in which a pawl is rotated by a first cable in an emergency opening structure for a frunk latch according to an embodiment of the present disclosure.
Figure 4C:
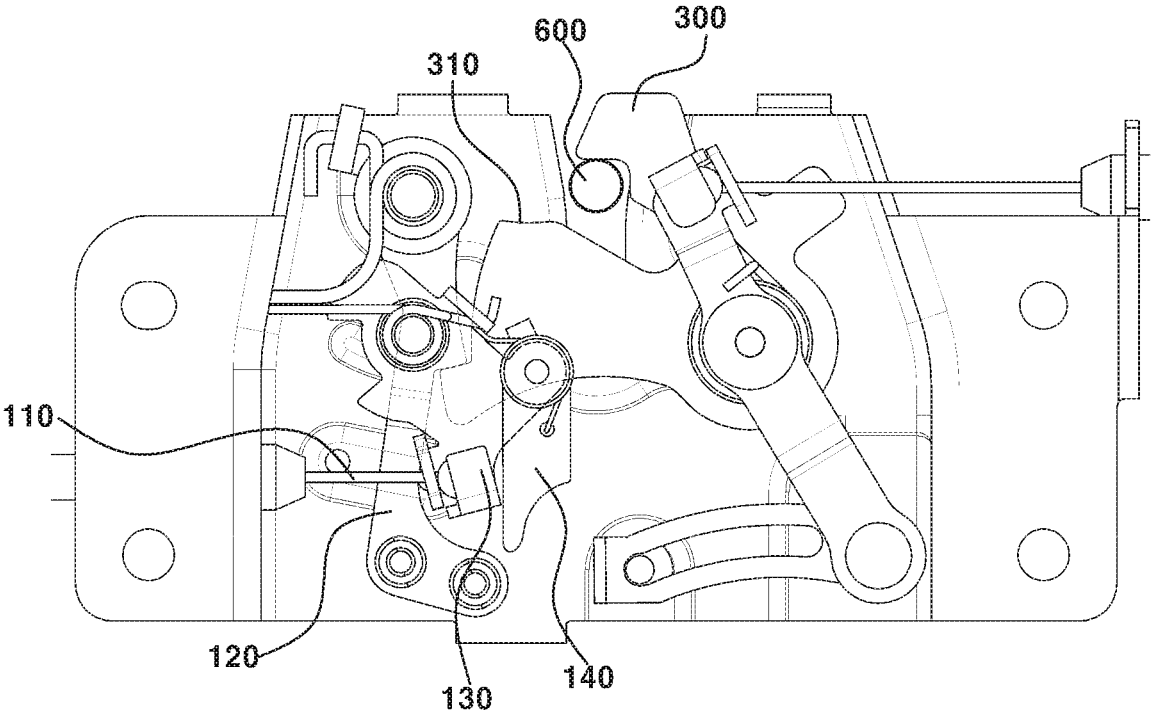
FIG. 4C is a view illustrating the state in which first-stage locking is released by a first cable in an emergency opening structure for a frunk latch according to an embodiment of the present disclosure.

FIG. 4A is a view illustrating the state in which tension is initially applied to the first cable 110, FIG. 4B is a view illustrating the state in which the release lever 130 and the blade lever 140 are operated by the application of tension and the pawl 120 is rotated in conjunction therewith, and FIG. 4C is a view illustrating the coupling relationships among the components in the state in which the first-stage locking of the frunk is released.

In the initial locked state, when tension is applied to the release lever 130 from the first cable 110 connected to the in-vehicle handle 400, the release lever 130, to which one end of the first cable 110 is secured, is rotated about the release center shaft 131.

The release lever 130, which is located on the back plate 150, is configured to form an operation plane that is located further forward than the operation plane of the pawl 120 in the forward-backward direction of the base 100. Further, the blade lever 140, which is located on one surface of the release lever 130, is configured to be operated at a position further forward than the operation plane of the release lever 130.

In summary, the pawl 120 and the catch 300 are located on the base 100 so as to have the same operation plane as each other, the release lever 130 is located in the operation plane of the pawl 120, and the blade lever 140 is located in the operation plane of the release lever 130.

When the release lever 130 is rotated by the first cable 110, the blade lever 140, which is located on one surface of the releaser lever 130, becomes adjacent to the second boss 123. When the amount of tension applied from the first cable 110 exceeds a predetermined level, the other end of the blade lever 140 catches on the first boss 122, which is located at one end of the pawl 120, thereby applying the tension to the pawl 120.

The other end of the pawl 120, at which the bosses 124 are located, is rotated about the pawl center shaft 121 by the tension applied to the first boss 122 by the blade lever 140.

The release lever 130, the blade lever 140, and the pawl 120 are rotated in the same direction by the tension applied thereto from the first cable 110, and the catch 300, which catches on the pawl 120, is also rotated in the same direction as the pawl 120.

Referring to FIG. 4C, when the first-stage locking is released, the first latching protrusion 310 of the catch 300 is released from the pawl 120 by the first cable 110, and the second latching protrusion 320 catches on the pawl 120. When the tension applied thereto from the first cable 110 is removed, the release lever 130 and the blade lever 140 are restored to the original states thereof.

A spring is provided on the release center shaft 131 so as to apply elastic force to the release lever 130 in a direction opposite the direction in which the tension is applied to the release lever 130 from the first cable 110. When the force of manipulating the in-vehicle handle 400 is removed, the release lever 130 is restored to the original state thereof.

Further, the blade lever 140, which is located on one surface of the release lever 130, is moved away from the bosses 124 of the pawl 120 and is restored to the original state thereof by a spring provided on the blade center shaft 141.

In addition, when the first-stage locking is completely released, the second latching protrusion 320 of the catch is maintained in the state of catching on the pawl 120. Compared with the initial locked state, the end of the pawl 120, at which the bosses 124 are located, is spaced apart from the blade lever 140.

As described above, the first-stage locking of the frunk is released in response to the operation of manipulating the in-vehicle handle 400 once. In this state, the second latching protrusion 320 of the catch 300 is caught in the recess in the pawl 120, whereby the second-stage locked state is maintained.

Figure 5A:
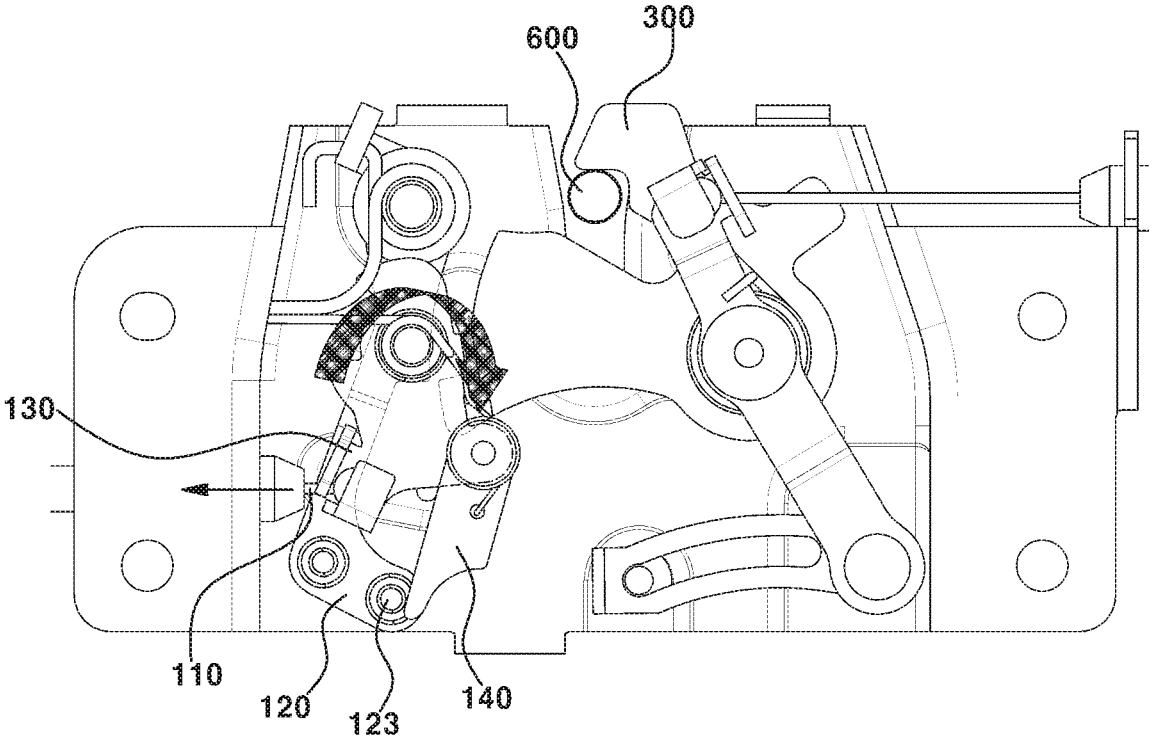
FIG. 5A is a view illustrating the state in which a pawl is further rotated by application of additional tension to a first cable in an emergency opening structure for a frunk latch according to an embodiment of the present disclosure.
Figure 5B:
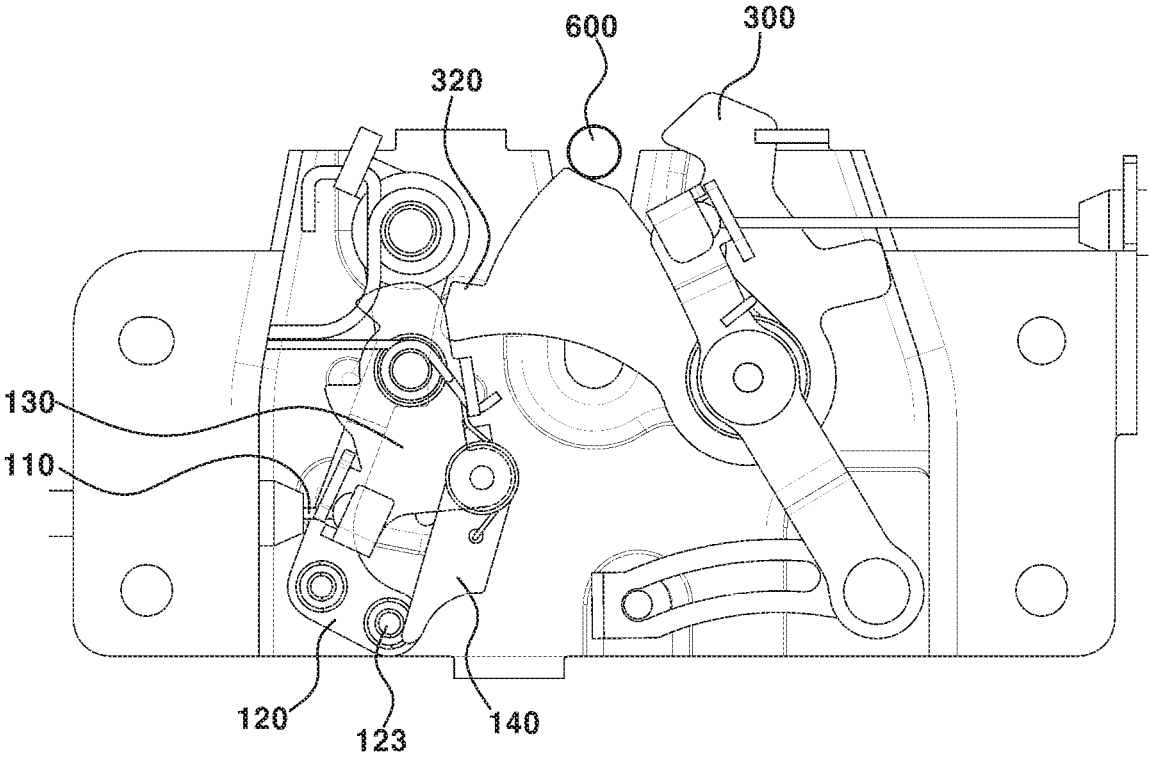
FIG. 5B is a view illustrating the state in which a blade lever is rotated by a first cable in an emergency opening structure for a frunk latch according to an embodiment of the present disclosure.
Figure 5C:
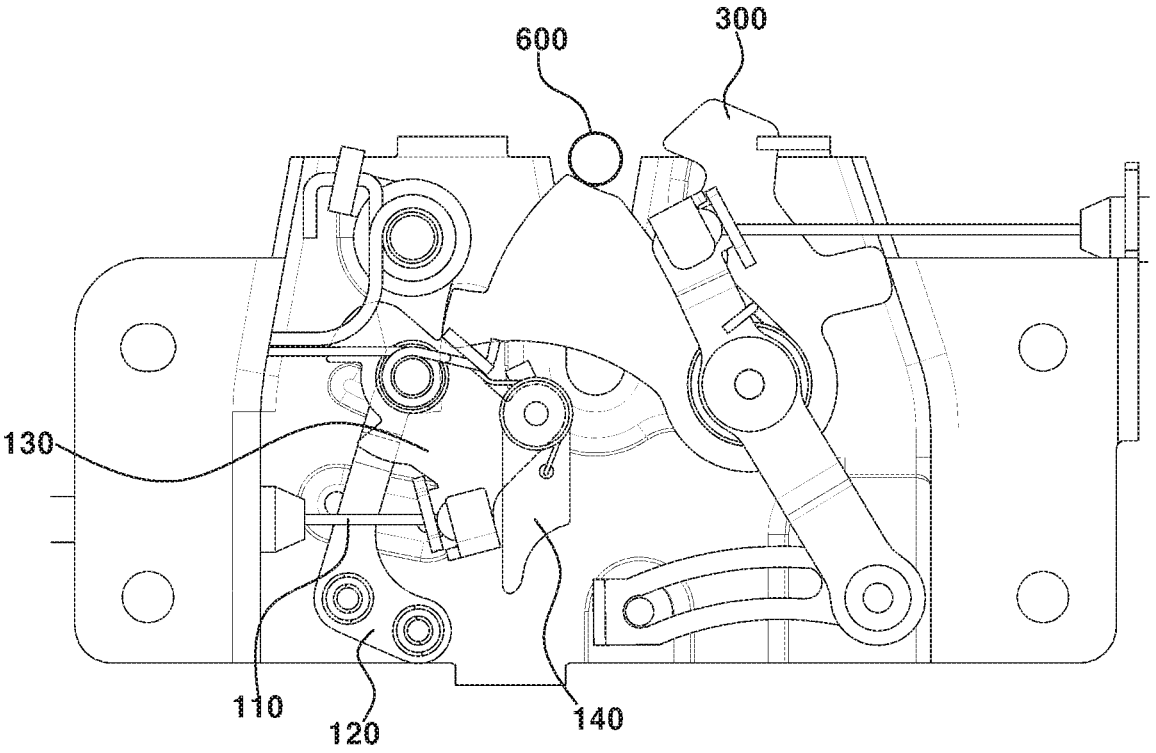
FIG. 5C is a view illustrating the state in which second-stage locking is released by a first cable in an emergency opening structure for a frunk latch according to an embodiment of the present disclosure.

FIG. 5A is a view illustrating the state in which additional tension is applied to the first cable 110 in order to release the second-stage locking in the basic mode, FIG. 5B is a view illustrating the state in which the catch 300 is completely opened by the tension from the first cable 110, and FIG. 5C is a view illustrating the coupling relationships among the components in the state in which the second-stage locking of the frunk is released.

As shown in FIG. 5A, in the basic mode, when the second manipulation is applied to the in-vehicle handle 400 in the state in which the first-stage locking is released, the release lever 130 is rotated by the tension from the first cable 110, and the blade lever 140 is rotated simultaneously with the release lever 130.

More preferably, in the state in which the first-stage locking is released, the release lever 130 and the blade lever 140 are rotated to predetermined angles and are restored to the original states thereof by the elastic force of the springs, which are located on the center shafts 131 and 141, in a direction opposite the direction in which the tension is applied thereto from the first cable 110, and the blade lever 140 is spaced apart from the bosses 124 of the pawl 120.

In addition, in the state in which the pawl 120 is rotated to a position adjacent to the first cable 110 upon release of the first-stage locking, when the in-vehicle handle 400 is again manipulated, the blade lever 140 catches on the bosses 124 of the pawl 120. More preferably, the blade lever 140 catches on the second boss 123, thereby further rotating the pawl 120.

When the blade lever 140 catches on the second boss 123 and the tension from the first cable 110 is transmitted to the pawl 120, the second latching protrusion 320 of the catch 300 is released from the recess in the pawl 120.

Referring to FIG. 5B, when the second latching protrusion 320 is released from the recess in the pawl 120, a seating recess formed in the catch 300 is rotated by an elastic member, which is located on the rotation shaft of the catch 300, in the direction in which a striker 600 is unlocked.

That is, when the first-stage locking is completely released, the end of the blade lever 140 is spaced apart from the bosses 124 of the pawl 120, and when additional tension is applied to the first cable 110 to release the second-stage locking, the blade lever 140 is rotated so as to catch on the second boss 123 provided at the end of the pawl 120.

More preferably, since the second boss 123 and the blade lever 140 are rotated together, the second latching protrusion 320 of the catch 300 is released from the recess in the pawl 120 by the rotation of the pawl 120, and the striker 600 is thus spaced apart from the seating recess in the catch 300 so as to be free.

As shown in FIG. 5C, when the second-stage locking is completely released, the seating recess in the catch 300 is oriented in the height direction of the base 100, and the striker 600 is thus unlocked from the base 100 and the catch 300.

Further, when the tension applied thereto from the first cable 110 is removed, the release lever 130 and the blade lever 140 are rotated to predetermined angles and are restored to the original states thereof by the springs provided on the release center shaft 131 and the blade center shaft 141.

Furthermore, when the second-stage locking is completely released and when the first-stage locking is completely released, the release lever 130 and the blade lever 140 are respectively restored to constant positions.

Figure 6A:
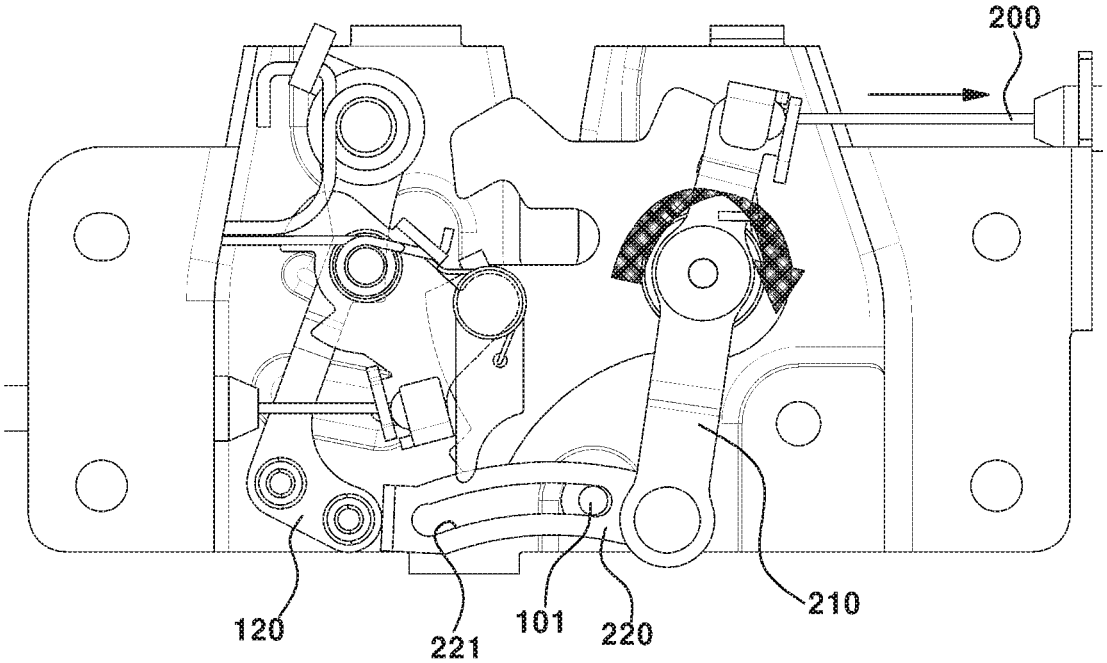
FIG. 6A is a view illustrating the state in which an emergency lever is rotated by a second cable in an emergency opening structure for a frunk latch according to an embodiment of the present disclosure.
Figure 6B:
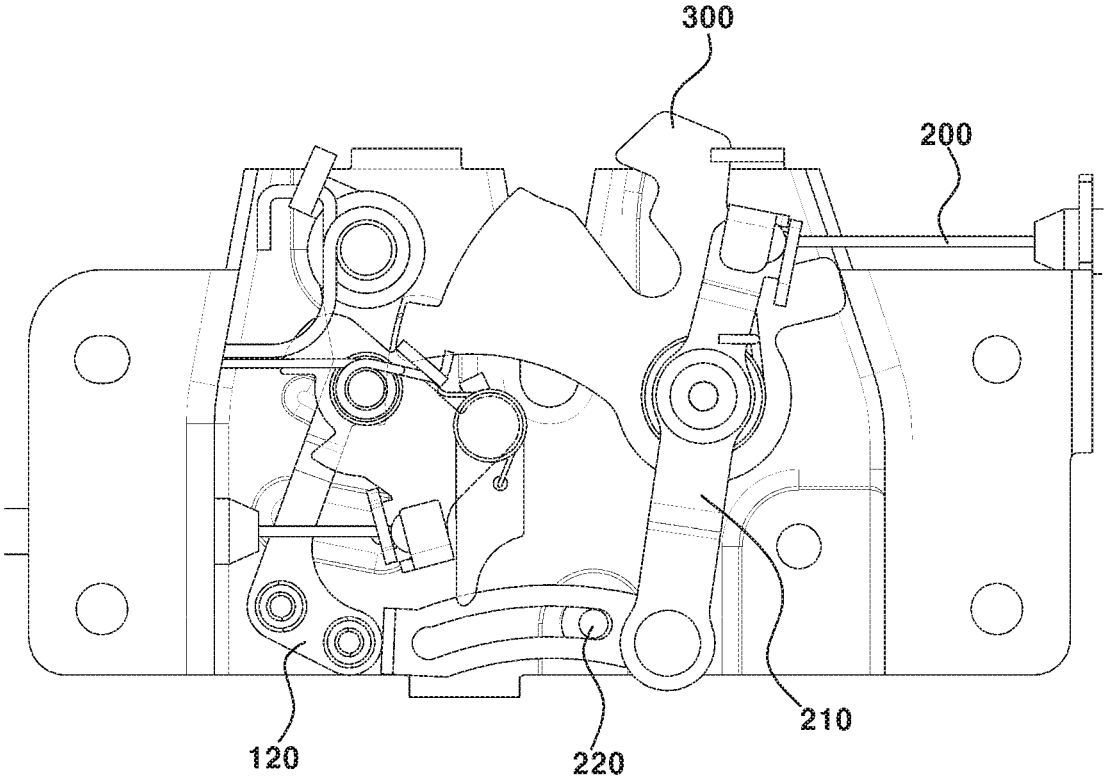
FIG. 6B is a view illustrating the state in which an emergency link is rotated by a second cable in an emergency opening structure for a frunk latch according to an embodiment of the present disclosure.

FIGS. 4A to 5C are views illustrating the coupling relationships among the components when the first-stage locking is released and when the second-stage locking is released in the basic mode, and FIGS. 6A and 6B are views illustrating the unlocking operation in the emergency mode.

FIG. 6A illustrates the unlocking operation in the emergency mode, which is performed when tension is applied to the second cable 200, which is located at a position symmetric to the position of the first cable 110 in the width direction of the base 100.

The second cable 200 is configured to apply tension to an emergency lever 210 when an in-frunk handle 500 is manipulated. The second cable 200 is connected to the upper end of the emergency lever 210, and the lower end of the emergency lever 210 is located adjacent to the end of the pawl 120, at which the bosses 124 are located, via an emergency link 220.

The emergency lever 210 has the same shaft as the catch 300, and is located on one surface of the catch 300. Further, the emergency lever 210 and the catch 300 are configured to be rotatable about the same shaft independently of each other.

In addition, the emergency link 220 is connected to the emergency lever 210 and moves in the same plane as the operation plane of the pawl 120. Thereby, the rotational force of the emergency lever 210 is transmitted to the pawl 120.

When the in-frunk handle 500 is manipulated and tension is thus applied to the second cable 200, one end of the emergency lever 210, to which the second cable 200 is connected, is rotated about a center shaft of the emergency lever 210, which is secured to the base 100, and the emergency link 220, which is connected to the other end of the emergency lever 210, is moved to a position adjacent to the pawl 120.

The emergency link 220 includes a guide slot 221 formed therein, and a protruding part 101 provided on the base 100 is located in the guide slot 221. Upon rotation of the emergency lever 210, the emergency link 220 is moved so as to be opposite the end of the pawl 120 while being guided by the protruding part 101.

The emergency link 220 and the emergency lever 210 are connected to each other via a single shaft. Therefore, the guide slot 221 may be formed in a curved shape such that the emergency link 220 moves linearly in accordance with rotation of the emergency lever 210.

When the emergency lever 210 is rotated by the second cable 200, the emergency link 220 comes into contact with the other end of the pawl 120, at which the bosses 124 are located. Thereafter, when the emergency lever 210 is further rotated by the tension applied thereto from the second cable 200, the pawl 120 is rotated in the same direction as the direction in which the pawl 120 is rotated in the basic mode. Upon rotation of the pawl 120, the first latching protrusion 310 and the second latching protrusion 320 are released from the pawl 120, and the catch 300 is rotated so as to be unlocked from the striker 600.

Further, when the in-frunk handle 500 is manipulated once, the emergency link 220 causes the pawl 120 to be rotated. The rotation of the pawl 120 causes the catch 300 to be successively rotated.

In summary, in the basic mode, the first-stage locking is released in response to the first manipulation of the in-vehicle handle 400, and the second-stage locking is released in response to the subsequent second manipulation of the in-vehicle handle 400. In the emergency mode, upon manipulating the in-frunk handle 500 once, the pawl 120 is rotated, and the catch 300 is successively rotated so as to be unlocked from the striker 600.

As is apparent from the above description, the emergency opening structure for a frunk latch according to embodiments of the present disclosure has the following effects.

Embodiments of the present disclosure provide an emergency opening structure for a frunk latch, which enables not only a basic opening mode but also an emergency opening mode, in which a person locked in the frunk is capable of opening the frunk, using a single latch structure, thereby reducing the size of the latch structure and manufacturing costs thereof.

In addition, since the mechanical-type latch structure is applied in place of an electric-type latch structure, the marketability of the product may be enhanced.

The foregoing detailed description of the present disclosure is merely illustrative. The foregoing content is intended to illustrate and describe exemplary embodiments of the present disclosure, and the present disclosure may be used in various other combinations, modifications, and environments. That is, the present disclosure may be modified or changed within the scope of the concept of the present disclosure disclosed herein, the scope equivalent to the foregoing content, and/or the scope of technology or knowledge known in the art. The embodiments described above are intended to describe the best mode for implementing the technical idea of the present disclosure, and various modifications required for specific applications and uses of the present disclosure are also possible. Thus, the foregoing detailed description is not intended to limit the present disclosure to the disclosed modes. The appended claims should be interpreted as also including other modes.

What is claimed is:

1. An emergency opening structure for a frunk latch, comprising:

a base configured to be secured to a vehicle body;

a pawl disposed on one surface of the base, the pawl being configured to be rotatable;

a first cable to which tension is applied by operation of an in-vehicle handle;

a release lever configured to apply tension of the first cable to the pawl;

a blade lever located at the release lever, the blade lever being configured to cause the pawl and the release lever to be operated together when the release lever is rotated by the first cable;

a second cable to which tension is applied by operation of an in-frunk handle;

an emergency lever having one end connected to the second cable and an opposite end configured to be rotatable and to interlock with the pawl;

a catch configured to be operated together with the pawl to unlock a striker; and a boss located at one end of the pawl, wherein the pawl is configured to be rotated when the blade lever catches on the boss and wherein the boss comprises a first boss located at the pawl and configured to cause the pawl to release first-stage locking when one end of the blade lever catches thereon and a second boss located at the pawl and configured to cause the pawl to release second-stage locking when additional tension is applied to the first cable and the end of the blade lever catches thereon.

2. The emergency opening structure of claim 1, wherein:

the blade lever is located on one surface of the release lever; and when tension is applied to the release lever from the first cable, the blade lever is configured to catch on the first boss or the second boss and rotate the pawl.

3. The emergency opening structure of claim 1, further comprising an emergency link located at the opposite end of the emergency lever, wherein, when the emergency lever is rotated by the second cable, the emergency link is configured to rotate one end of the pawl.

4. The emergency opening structure of claim 3, wherein the emergency link is configured to rotate the pawl.

5. The emergency opening structure of claim 3, wherein:

the emergency link comprises a guide slot formed therein, wherein a protruding part of the base is inserted in the guide slot; and the emergency link is configured to move while being guided by the protruding part to rotate the pawl.

6. The emergency opening structure of claim 1, wherein:

the catch comprises a first latching protrusion and a second latching protrusion; and when the pawl rotates, the first latching protrusion and the second latching protrusion are configured to sequentially catch on the pawl.

7. The emergency opening structure of claim 6, wherein, when rotational force is applied to the emergency lever, the emergency lever is configured to rotate the pawl such that the first latching protrusion and the second latching protrusion of the catch are released from the pawl.

8. The emergency opening structure of claim 1, further comprising an elastic member located on a center shaft of the catch and configured to rotate the catch in a direction in which the striker is unlocked.

9. A vehicle comprising:

a vehicle body; and a base secured to the vehicle body;

a pawl disposed on one surface of the base, the pawl being configured to be rotatable;

a first cable to which tension is applied by operation of an in-vehicle handle;

a release lever configured to apply tension of the first cable to the pawl;

a blade lever located at the release lever, the blade lever being configured to cause the pawl and the release lever to be operated together when the release lever is rotated by the first cable;

a second cable to which tension is applied by operation of an in-frunk handle;

an emergency lever having one end connected to the second cable and an opposite end configured to be rotatable and to interlock with the pawl; and a catch configured to be operated together with the pawl to unlock a striker, a boss located at one end of the pawl, wherein the pawl is configured to be rotated when the blade lever catches on the boss, wherein the boss comprises a first boss located at the pawl and configured to cause the pawl to release first-stage locking when one end of the blade lever catches thereon and a second boss located at the pawl and configured to cause the pawl to release second-stage locking when additional tension is applied to the first cable and the end of the blade lever catches thereon.

10. The vehicle of claim 9, wherein:

the blade lever is located on one surface of the release lever; and when tension is applied to the release lever from the first cable, the blade lever is configured to catch on the first boss or the second boss and rotate the pawl.

11. The vehicle of claim 9, further comprising an emergency link located at the opposite end of the emergency lever, wherein, when the emergency lever is rotated by the second cable, the emergency link is configured to rotate one end of the pawl.

12. The vehicle of claim 11, wherein:

the emergency link comprises a guide slot formed therein, wherein a protruding part of the base is inserted in the guide slot; and the emergency link is configured to move while being guided by the protruding part to rotate the pawl.

13. The vehicle of claim 9, wherein:

the catch comprises a first latching protrusion and a second latching protrusion;

when the pawl rotates, the first latching protrusion and the second latching protrusion are configured to sequentially catch on the pawl; and when rotational force is applied to the emergency lever, the emergency lever is configured to rotate the pawl such that the first latching protrusion and the second latching protrusion of the catch are released from the pawl.

14. The vehicle of claim 9, further comprising an elastic member located on a center shaft of the catch and configured to rotate the catch in a direction in which the striker is unlocked.

15. An emergency opening structure for a frunk latch, comprising:

a base configured to be secured to a vehicle body;

a pawl disposed on one surface of the base, the pawl being configured to be rotatable;

a first cable to which tension is applied by operation of an in-vehicle handle;

a release lever configured to apply tension of the first cable to the pawl;

a blade lever located at the release lever, the blade lever being configured to cause the pawl and the release lever to be operated together when the release lever is rotated by the first cable;

a second cable to which tension is applied by operation of an in-frunk handle;

an emergency lever having one end connected to the second cable and an opposite end configured to be rotatable and to interlock with the pawl;

an emergency link located at the opposite end of the emergency lever and configured to rotate the pawl, a catch configured to be operated together with the pawl to unlock a striker; and a boss located at one end of the pawl wherein the pawl is configured to be rotated when the blade lever catches on the boss, wherein the boss comprises a first boss located at the pawl and configured to cause the pawl to release first-stage locking when one end of the blade lever catches thereon and a second boss located at the pawl and configured to cause the pawl to release second-stage locking when additional tension is applied to the first cable and the end of the blade lever catches thereon.

16. The emergency opening structure of claim 15, wherein:

the blade lever is located on one surface of the release lever; and when tension is applied to the release lever from the first cable, the blade lever is configured to catch on the first boss or the second boss and rotate the pawl.

17. The emergency opening structure of claim 15, wherein:

the emergency link comprises a guide slot formed therein, wherein a protruding part of the base is inserted in the guide slot; and the emergency link is configured to move while being guided by the protruding part to rotate the pawl.

18. The emergency opening structure of claim 15, wherein:

the catch comprises a first latching protrusion and a second latching protrusion; and when the pawl rotates, the first latching protrusion and the second latching protrusion are configured to sequentially catch on the pawl.

19. The emergency opening structure of claim 18, wherein, when rotational force is applied to the emergency lever, the emergency lever is configured to rotate the pawl such that the first latching protrusion and the second latching protrusion of the catch are released from the pawl.

20. The emergency opening structure of claim 15, further comprising an elastic member located on a center shaft of the catch and configured to rotate the catch in a direction in which the striker is unlocked.

* * * * *